US007476092B1

(12) United States Patent
Bush

(10) Patent No.: US 7,476,092 B1
(45) Date of Patent: Jan. 13, 2009

(54) SCROLL COMPRESSOR WITH TAPERED SLIDER BLOCK

(75) Inventor: James William Bush, Skaneateles, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 11/850,047

(22) Filed: Sep. 5, 2007

(51) Int. Cl.
*F03C 2/00* (2006.01)
*F03C 4/00* (2006.01)
*F04C 2/00* (2006.01)

(52) U.S. Cl. ..... 418/55.5; 418/57; 418/182

(58) Field of Classification Search ..... 418/55.1–55.6, 418/57, 94, 182
See application file for complete search history.

(56) References Cited

U.S. PATENT DOCUMENTS 5,219,281 A * 6/1993 Caillat et al. ..... 418/55.6
5,433,589 A * 7/1995 Wada et al. ..... 418/55.5
7,273,363 B1 * 9/2007 Sun et al. ..... 418/55.5
7,284,972 B2 * 10/2007 Sun ..... 418/55.5

FOREIGN PATENT DOCUMENTS

JP 03237284 A * 10/1991 ..... 418/55.5
JP 04072484 A * 3/1992 ..... 418/57

* cited by examiner

*Primary Examiner*—Theresa Trieu
(74) *Attorney, Agent, or Firm*—Carlson, Gaskey & Olds

(57) ABSTRACT

The drive connection between an eccentric pin and a slider block in a scroll compressor is angled such that any vertical force between the two will drive the slider block away from the orbiting scroll member. In this manner, manufacturing tolerances will not result in any drive connection which can have a net vertical force driving the slider block toward the orbiting scroll member.

3 Claims, 3 Drawing Sheets

SCROLL COMPRESSOR WITH TAPERED SLIDER BLOCK

BACKGROUND OF THE INVENTION

This application relates to a scroll compressor, wherein a slider block is formed with an intentional taper such that any axial force created between an eccentric pin and the slider block is in a direction opposed from the scroll pump set.

Scroll compressors have become widely utilized in refrigerant compression applications. In a scroll compressor, a first scroll member has a base and a generally spiral wrap extending from its base. A second scroll member has a base and a generally spiral wrap extending from its base. The wraps of the two scroll members interfit to define compression chambers. A motor drives a driveshaft to rotate. The driveshaft has an eccentric pin at an upper end which extends into a slider block. The slider block is positioned between the eccentric pin and a boss extending from the base of the second scroll member. Rotation of the shaft causes the eccentric pin to move within the slider block, and to in turn cause the orbiting scroll to move. A non-rotational coupling ensures that the second scroll member orbits relative to the first scroll member.

In the prior art, it is known to have a barrel shape formed on one of the pin and the slider block. This shape reduces the contact area. However, with manufacturing tolerances, there are times when a barrel shape on the pin can interfit with an unintended angled surface on the slider block such that a total force from the interaction of the pin and the slider block includes a vertical or axial component directed toward the scroll pump set. This can lead to problems, such as rubbing of an upper surface of the slider block and the lower surface of the second scroll member. Again, such an occurrence can be caused by manufacturing tolerances on the slider block drive surface.

SUMMARY OF THE INVENTION

In the disclosed embodiment of this invention, a contact surface in the slider block is angled such that any force created between the eccentric pin and the slider block would include an axial component away from the pump set. In this manner, the slider block is not urged toward the second scroll member, but instead in an opposed direction. The present invention preferably includes an angle that is sufficient to ensure that any slider blocks that would fall within acceptable tolerances would have the force directed in the mentioned direction.

These and other features of the present invention can be best understood from the following specification and drawings, the following of which is a brief description.

DETAILED DESCRIPTION OF THE PREFERRED EMBODIMENT

Figure 1:
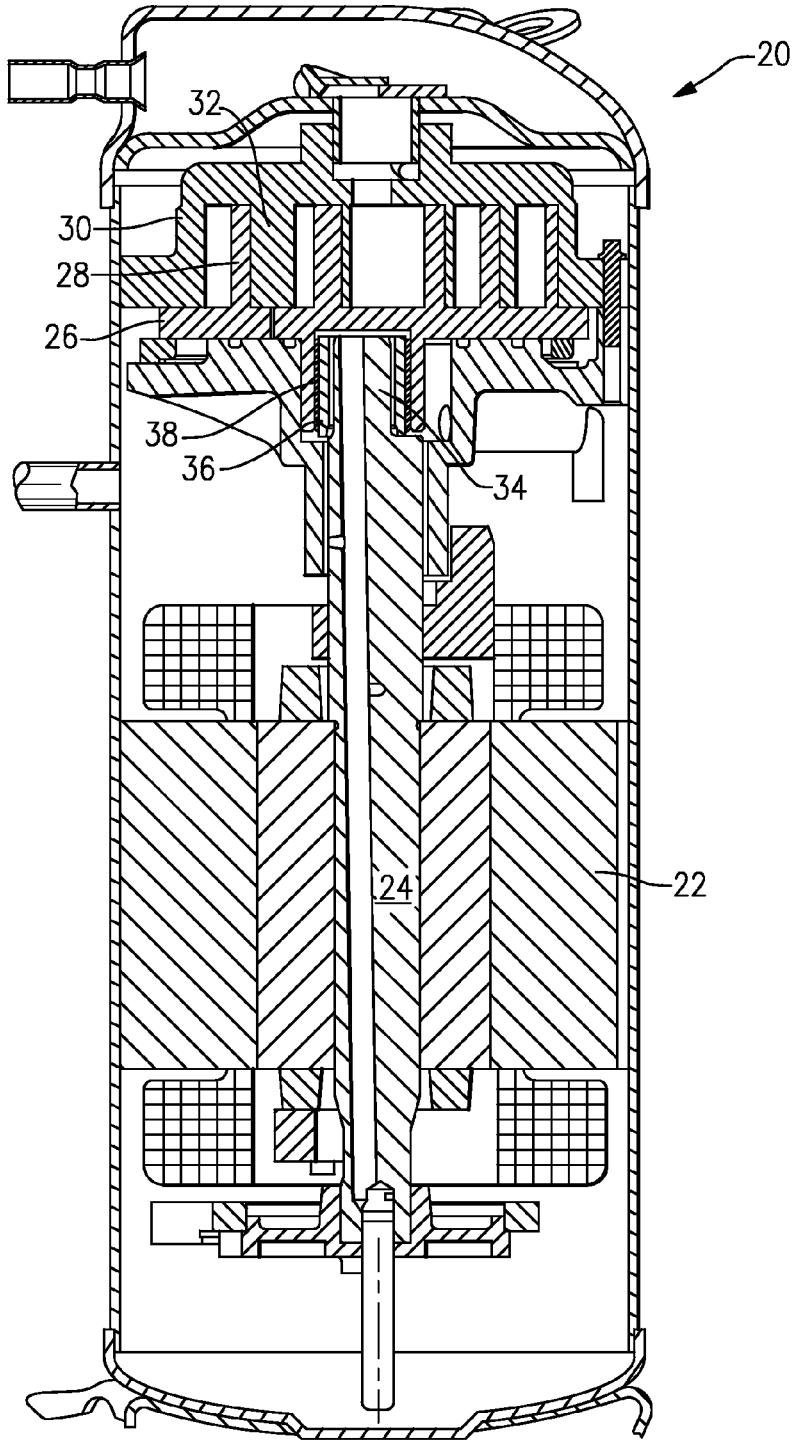
FIG.1 Prior Art
FIG. 1 shows a prior art scroll compressor.

FIG. 1 shows a scroll compressor 20 incorporating an electric motor 22 which drives a shaft 24 to rotate. Shaft 24 causes an orbiting scroll member 26 having a wrap 28 to orbit relative to a non-orbiting scroll member 30 having its own wrap 32. An eccentric pin 34 is formed at an end of the shaft 24. The eccentric pin 34 fits within a slider block 36, which is placed between the eccentric pin 34 and a boss 38 extending from the non-orbiting scroll 26.

Figure 2A:
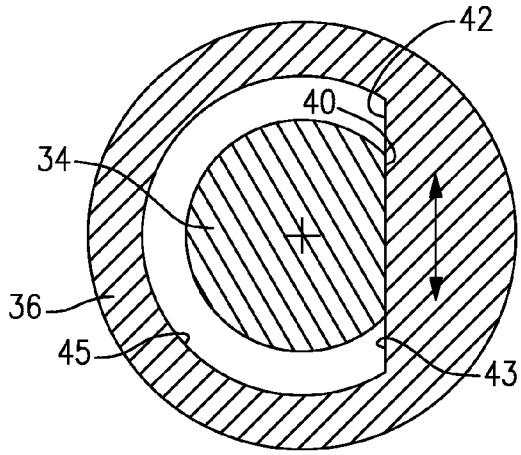
FIG.2A Prior Art
FIG. 2A shows a feature in the prior art scroll compressor.

As shown in FIG. 2A, the eccentric pin 34 and the slider block 36 have flat surfaces which move into contact with each other to provide a drive connection. As shown, the eccentric pin 34 has a flat surface 40 abutting a flat surface 43 on an inner periphery of the bore 42 in the slider block 36. A generally curved surface 45 is formed at other locations within the bore 42.

Figure 2B:
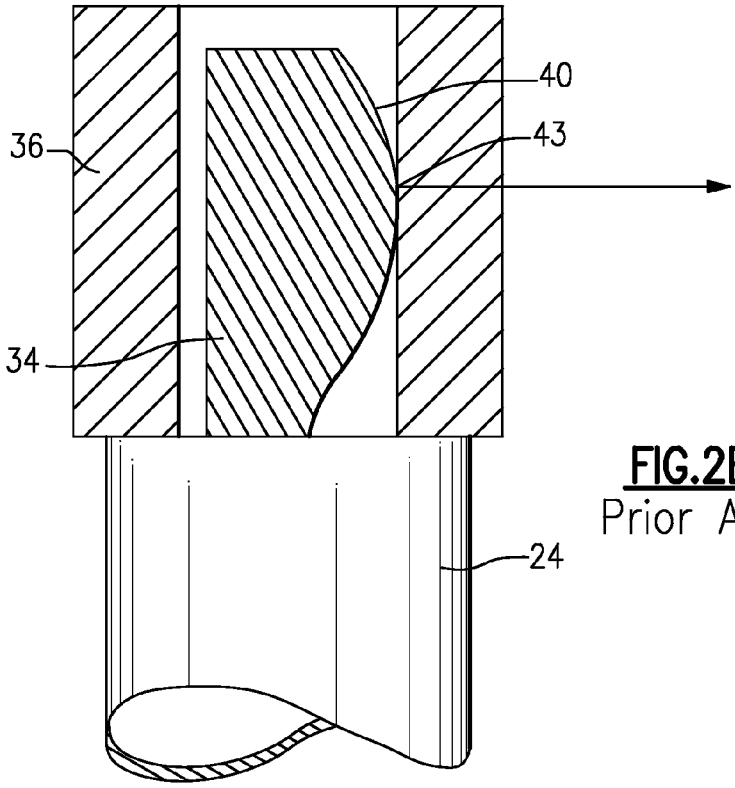
FIG.2B Prior Art
FIG. 2B shows another view of the prior art scroll compressor.

As shown in FIG. 2B, in the prior art, the eccentric pin 34 has a barrel shape on its flat drive surface 40. Thus, when the surface 40 contacts the surface 43, there is point contact, reducing frictional losses between the two. The amount of the barrel shape in this figure is exaggerated, to better illustrate the feature. In this theoretical construction, the direction of the contact force is directly radially outwardly of the point of contact.

Figure 3:
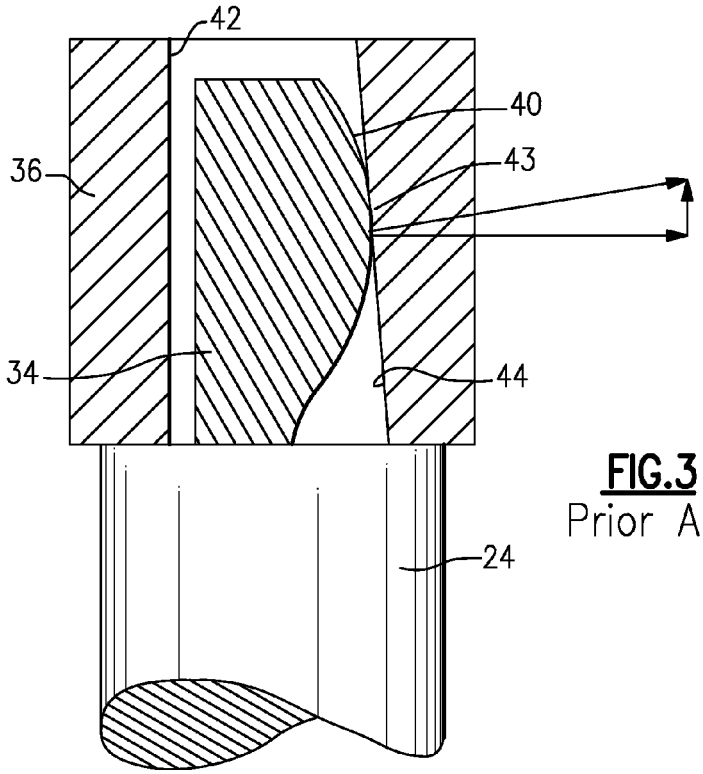
FIG.3 Prior Art
FIG. 3 illustrates a problem that can occur with the prior art scroll compressor.

However, as shown in FIG. 3, in the real world, there are manufacturing tolerances. In some cases, these manufacturing tolerances could include the flat surface in the slider block bore 42 being angled as shown, such that it is angled radially outwardly in a direction moving away from the orbiting scroll member at 44. Now, the direction of the contact force will have a vertical component as shown. This vertical component could cause the slider block 42 to move upwardly toward the base of the orbiting scroll, potentially causing rubbing and frictional losses. This is undesirable.

Figure 4:
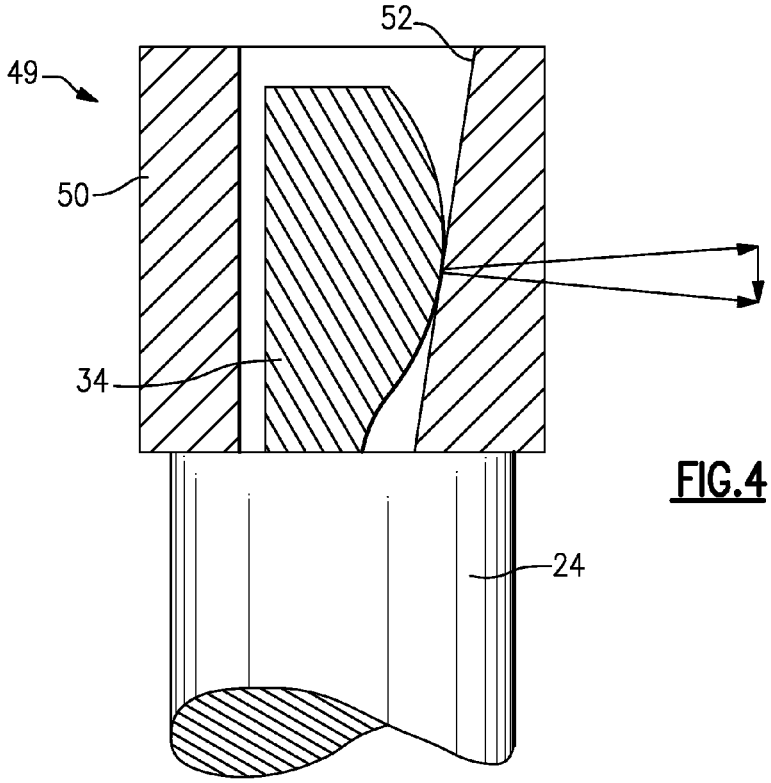
FIG. 4 shows an inventive scroll compressor.

FIG. 4 shows an inventive scroll compressor 49. In inventive scroll compressor 49, the slider block 50 is formed such that its flat surface 52 is angled to move radially inwardly along a direction away from the base of the orbiting scroll member. In this manner, regardless of manufacturing tolerances, there is a vertical force created by the contact between the eccentric pin 34 and the surface 52, however that vertical force would be away from the orbiting scroll member. Thus, the slider block 52 is forced against the shaft 24, eliminating the problem mentioned above. That is, it could be said that the flat surface of the slider block extends at an angle that is non-parallel to the axis of the driveshaft and along a direction moving away from the base of the orbiting scroll, such that the generally flat surfaces on the eccentric pin and the slider block have a resultant force on the slider block urging the slider block away from the orbiting scroll due to the flat surface on the slider block being formed to extend radially inwardly along this angle.

Thus, as can be understood from FIGS. 2 and 4, the flat surface 52 on the slider block bore is flat in a plane taken perpendicular to a drive axis of the shaft 24. On the other hand, it is angled relative to that drive axis, as shown in FIG. 4.

In a preferred embodiment the angle is at least large enough to ensure that within the extreme range of tolerances, the force will still be downward.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a base and a generally spiral wrap extending from the base;

a second scroll member having a base and generally spiral wrap extending from its base, said spiral wraps of said first and second scroll members interfitting to define compression chambers;

said second scroll member having a boss extending from the base in an opposed direction relative to the generally spiral wrap, a driveshaft being driven to rotate by a motor about an axis, and said driveshaft having an eccentric pin extending upwardly into said boss, and a slider block positioned between said eccentric pin and said boss; and said eccentric pin and said slider block each having a generally flat surface in contact with each other to cause rotational movement of said rotating shaft to be transmitted to said second scroll member through said slider block, and said flat surface on said slider block being formed to extend radially inwardly at an angle that is non-parallel to said axis, and along a direction moving away from said base of said second scroll member, said generally flat surfaces on said eccentric pin and said slider block having a resultant force on said slider block urging said slider block away from said second scroll member due to said flat surface on said slider block being formed to extend radially inwardly along said angle.

2. The scroll compressor as recited in claim 1, wherein said flat surface of said slider block extends along a single angled surface.

3. The scroll compressor as recited in claim 2, wherein said single angled surface is generally flat in a plane perpendicular to said axis.

* * * * *